United States Patent [19]

Hirschfeld

[11] Patent Number: 5,033,736

[45] Date of Patent: Jul. 23, 1991

[54] PASSIVE EXERCISE BICYCLE

[76] Inventor: Scott M. Hirschfeld, 11151 Glacier Dr., St. Louis, Mo. 63146-5630

[21] Appl. No.: 444,294

[22] Filed: Dec. 1, 1989

[51] Int. Cl.[5] ..... A63B 23/04

[52] U.S. Cl. ..... 272/73; 128/25 R

[58] Field of Search ..... 272/73; 128/25 R

[56] References Cited

U.S. PATENT DOCUMENTS

| | | | |
|---|---|---|---|
| D. 299,669 | 1/1989 | Harter | D21/194 |
| 2,202,187 | 5/1940 | Chalette | 272/73 |
| 3,730,174 | 5/1973 | Madison | 272/73 |
| 3,744,480 | 7/1973 | Gause et al. | 272/73 |
| 4,402,502 | 9/1983 | Peters | 128/25 R |
| 4,717,146 | 1/1988 | Nohara | 272/73 |
| 4,824,132 | 4/1989 | Moore | 272/73 |

*Primary Examiner*—Stephen R. Crow

*Attorney, Agent, or Firm*—Kalish & Gilster

[57] ABSTRACT

A passive exercise bicycle comprises a frame and conventional motor attached to a stabilizing support surface. A bushing which drives a wheel attached to the bicycle frame is mounted on a shaft turned by a motor. The wheel in turn is attached by a conventional bicycle chain to the pedals of the exercise bicycle. The motor thereby drives the pedals to which are attached the feet of a person seated in a wheel chair positioned in close proximity to the bicycle. The bicycle carries easily accessible control switches for use by such person.

18 Claims, 3 Drawing Sheets

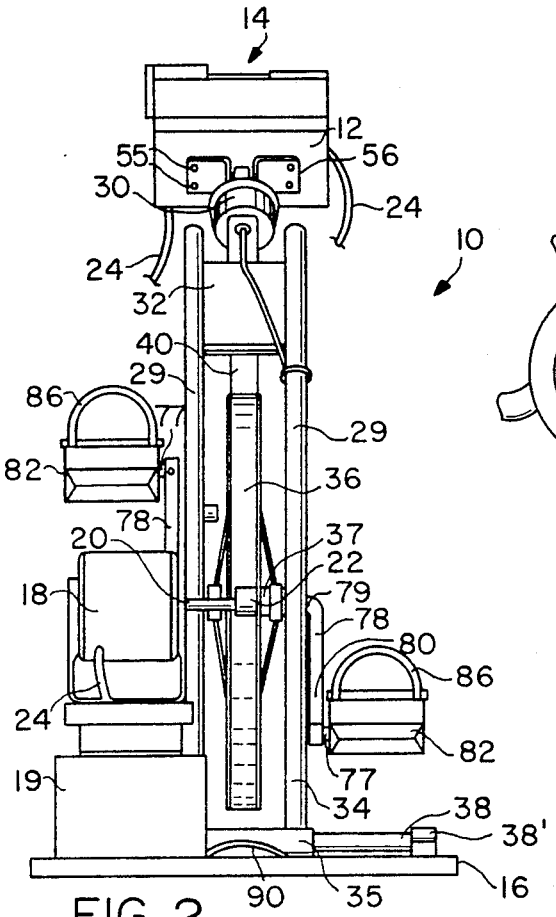
FIG. 2
FIG. 4
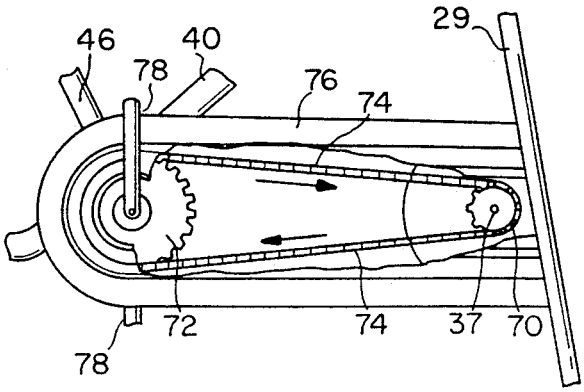
FIG. 3
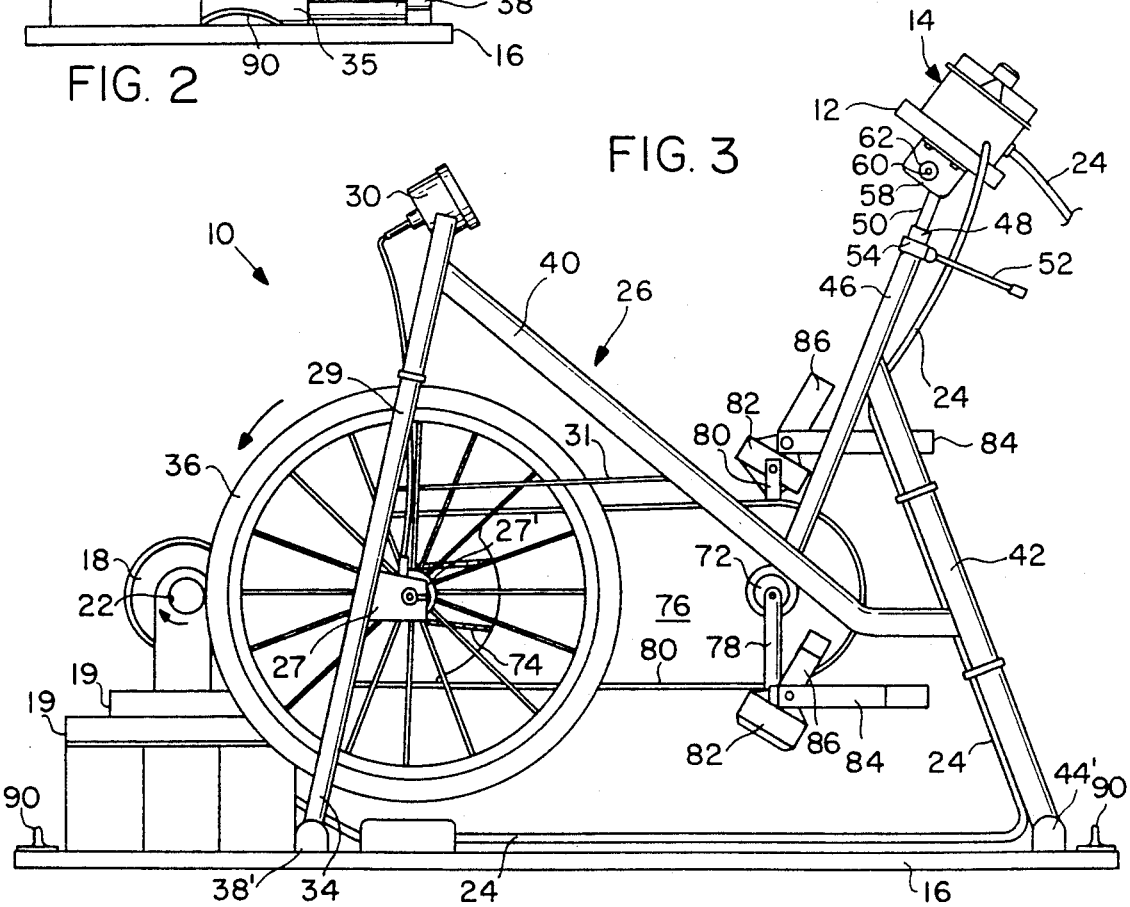

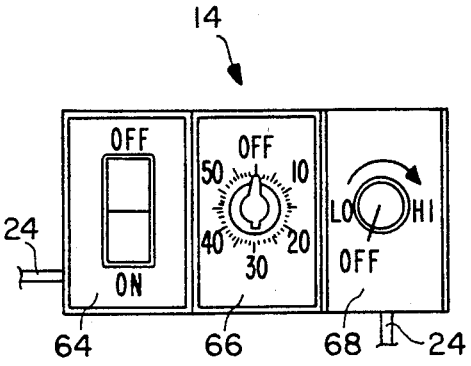
FIG. 5
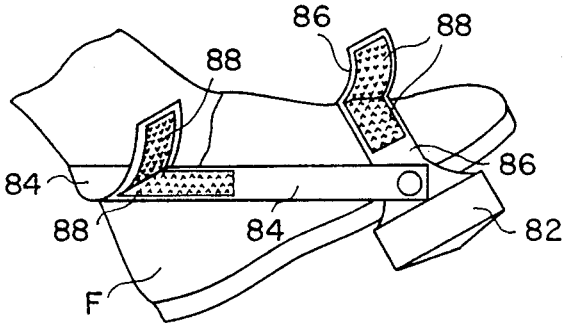
FIG. 6
FIG. 7
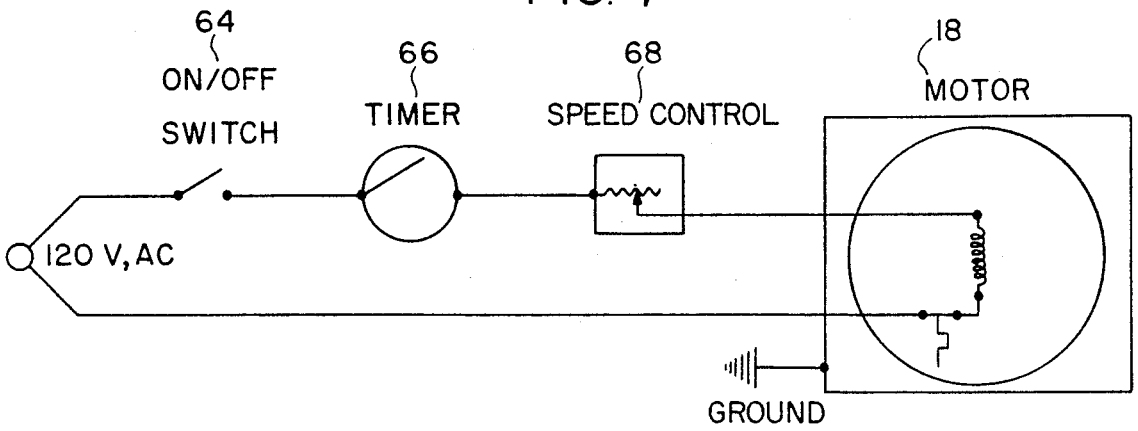

PASSIVE EXERCISE BICYCLE

BACKGROUND OF THE INVENTION

1. Field of the Invention

The present invention relates, in general, to exercise bicycles and, more particularly, to a motorized, passive exercise bicycle adapted for use by paraplegic or quadraplegic people, as well as geriatrics or other individuals with reduced leg use function.

2. Description of the Prior Art

People who have suffered spinal cord injuries and are paralyzed, or who have otherwise lost or suffered decreased use of their legs frequently require extensive physical therapy and expensive equipment to treat or prevent atrophy and spasms of the leg muscles and swelling of the legs. Heretofore, devices have been developed to treat these problems in such individuals. For example, U.S. Pat. No. 3,730,174, issued to Madison, describes an exercise unit for paraplegic individuals. The Madison unit comprises motor driven pedals attached to a drive train carried upon a beam which travels under and is attached to a chair. Being a combination of chair and exerciser, the device to Madison requires that the user move from a bed or ordinary chair, wheeled or otherwise, to the chair of the device. That is, a wheelchair-bound patient cannot simply roll up to the machine and access it from his own chair. Furthermore, transfer of the user to the exercise device may require trained assistance.

U.S. Pat. No. 4,402,502 to Peters reveals an exerciser for disabled persons. The Peters device permits exercising of both arms and legs simultaneously, but comprises a very complex machine which is entirely enclosed in a housing, the upper portion of which housing telescopes into the lower portion thereof. The Peters device discloses a complex linkage system which includes a speed reducer which is enclosed within the housing, and thus is inaccessible by the operator. Furthermore, it requires that the user roll in a wheelchair entirely onto a platform which supports the device. In such position the weight of the user acts to stabilize the machine. The controls of the Peters exerciser 6, 7, 8 are placed on the extreme front of the machine and thus are not easily accessible to the user.

Consequently, the prior art structures relating to exercise devices for disabled individuals are both complicated and expensive, as well as being very difficult for the individual alone to use. Ordinarily, such machines require that an attendant be present to assist the patient, rather than permitting the patient to approach the machine and exercise relatively independently.

SUMMARY OF THE INVENTION

Therefore, it is an object of the present invention to provide a passive exercise bicycle for individuals afflicted with decreased usage of their legs, such as paraplegics or quadraplegics, which bicycle may to a great extent be used by the patient independently.

It is another object of this invention to provide a passive exercise bicycle of the character stated that is of simple construction and therefore relatively inexpensive to purchase, thus increasing availability to potential users.

It is a further object of this invention to provide an exercise bicycle of the character stated which permits the user to prevent or decrease the incidence of leg muscle spasms, atrophy or swelling by usage of such device.

It is still another object of this invention to provide an exercise bicycle of the character stated which may be used by the patient either alone or with relatively minimal assistance by an attendant.

It is yet another object of this invention to provide an exercise bicycle of the character stated which when used over an extended period of time may decrease or eliminate the need for expensive, professional physical therapy.

It is another object of this invention to provide an exercise bicycle of the character stated having foot supports which are adapted for use with any shoe size.

It is a further object of this invention to provide an exercise bicycle of the character stated having controls consisting of an adjustable speed nob, an on/off switch and a timer, which controls are easily accessible and usable by the seated user, such controls being adjustable for increased accessibility.

It is a still further object of this invention to provide an exercise bicycle of the character stated which is fixed to a platform such that the bicycle may be used by a patient in a wheelchair or from other seats such as a conventional chair, which may be closely positioned relative to the exercise bicycle; which being so fixed does not require additional weights in order to keep it in such relative position.

Accordingly, the present invention comprises, briefly, a passive exercise bicycle for use by a person seated in a chair, said bicycle comprising a vertical frame having a front portion, a rear portion and two opposing side portions. A foot pedal is rotatably attached adjacent to and extends outwardly from each opposing side portion near the rear portion of the frame. A pedal crank assembly simultaneously connects and supports the foot pedals in offset relationship relative to each other and permits rotatable attachment to the frame. Straps are attached to each foot pedal for securing the user's feet thereto. A vertical wheel is rotatably supported by a central axle at the front portion of the frame and front and rear sprockets and a bicycle chain connect the wheel to the pedals. Hand controls and an electrically supplied motor permit selective rotation of the wheel and a support surface permits fixed securement thereto of the frame and power supply. Thus, a person seated in a chair in alignment with the bicycle and facing the rear portion thereof may have his feet strapped to the foot pedals for passive exercise of his lower body by selective rotation of the vertical wheel.

Other objects and features will be in part apparent and in part pointed out herein below.

BRIEF DESCRIPTION OF THE DRAWINGS

FIG. 2 is a front end view of the bicycle of FIG. 1 taken on the line 2—2.

FIG. 3 is a left side elevational view of the bicycle of FIG. 1.

FIG. 4 is a fragmented partial side view of the bicycle of FIG. 1.

FIG. 5 is an elevational view of the controls of the bicycle of FIG. 1 taken on the line 5—5.

FIG. 6 is a partial view of the bicycle of FIG. 1 showing the user's foot as it would be strapped onto the pedal.

FIG. 7 is a schematic illustration of the electric circuitry of the passive exercise bicycle of FIG. 1.

DESCRIPTION OF THE PREFERRED EMBODIMENT OF THE INVENTION

Figure 1:
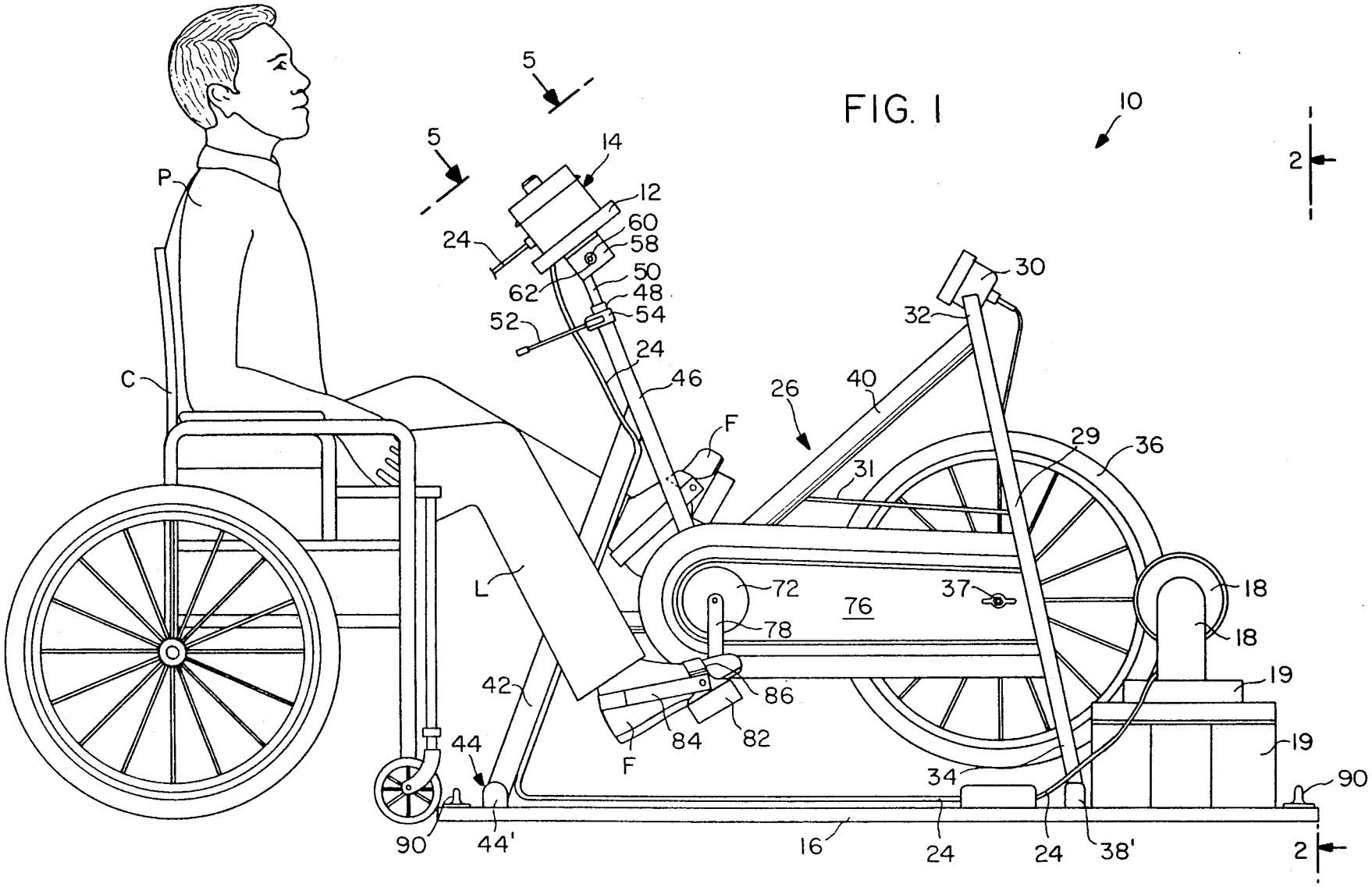
FIG. 1 is a right side elevational view of the passive exercise bicycle constructed in accordance with and embodying present invention and having a user in position therewith.

Referring now by reference characters to the Figures, 10 generally designates a passive exercise bicycle constructed in accordance with and embodying the present invention. Bicycle 10 comprises a conventional stationary bicycle adapted for use by a quadraplegic or paraplegic person seated in a wheelchair C (FIG. 1) or other standard chair behind bicycle 10. More particularly, the seat (not shown) of a stationary bicycle has been removed and replaced with a support pad 12 for electrical controls 14, the handle bars (not shown) have been removed, as being unnecessary, and bicycle 10 has been fixedly mounted upon a flat board or other support surface 16 for stability.

Bicycle 10 is composed basically of a vertical frame 26 preferably constructed of tubular metal and having a pair of substantially vertical posts 29, at the forward end thereof, having a common upper end plate 32 and two independent lower ends 34; the former which ordinarily is the general site of handlebars (not shown) but is used in bicycle 10 as a location for mounting a speedometer 30. Posts 29 pass downwardly, on each side of and parallel to a vertical bicycle wheel 36, which is rotatably attached spacedly upward from support surface 16 to posts 29 by flanges 27 secured thereto and each having a notch 27' for journalling the axle 37 of wheel 36 (FIG. 3). Posts 29 terminate in lower ends 34 which are secured by a horizontal front tubular member 35 to a front horizontal bar 38, which in turn is fixed by screws or other conventional means (not shown) to support board 16.

A single substantially diagonal bar 40 is welded to, and extends downwardly and rearwardly from, the common upper end plate 32 of posts 29 to connect with a rear post 42. Additional frame 26 support is provided by rod 31 which horizontally attaches diagonal bar 40 to each post 29 (FIGS. 1 and 3). A rear horizontal bar 44 (not shown) identical to bar 38 is fixed parallel to and in like manner as front horizontal bar 38 to support surface 16. Rear post 42 is welded at its rear end to a horizontal rear tubular member (not shown), such as 35, by which it is attached to rear horizontal bar 44 and extends upwardly and forwardly therefrom. Bars 38, 44 each terminate respectively in plastic tips 38', 44', to protect users from the otherwise exposed sharp ends thereof (not shown).

Extending upwardly and rearwardly from diagonal bar 40 and supported by rear post 42 is an outer tube 46 into which fits telescopingly an inner tube 50. Which tube 50 is selectively positionable therein by rotation of handle 52 to loosen or tighten a clamp 54 encircling the mouth 48 of outer tube 46 around inner tube 50.

Mounted atop inner tube 50 is support pad 12 for affixing controls 14 thereon. Support pad 12 is attached to tube 50 by screws 55 inserted through horizontal bracket flanges 56 into pad 12. Vertical flanges 58 depend from horizontal flanges 56 to flank inner tube 50 and are capable of tightening thereto by application of a nut 60 to a bolt 62 which horizontally penetrates vertical flanges 58 and permits selective tilting of flanges 58 (and therefore pad 12) thereon.

Controls 14 for bicycle 10 (FIG. 5) preferably comprise a large toggle-type on/off switch 64, a simple timer 66 and a rheostat, or speed control, 68. Controls 14 are connected by a conventional electric cord 24 to standard household 120 volt alternating current, as well as to a motor 18 which is attached to a base 19 mounted upon support surface 16 near the front of bicycle 10. FIG. 7 illustrates schematically the above electronic circuitry. Motor 18 carries a drive shaft 20 terminating in a bushing 22 and is positioned such that bushing 22 is in contact edgewise with wheel 24, such that rotation of bushing 22 causes wheel 24 to rotate in an opposite direction, as shown by arrows in FIG. 3.

As shown in FIG. 4, a toothed front sprocket 70 is provided upon one end of axle 37 and is spacedly connected to a toothed rear sprocket 72 by a bicycle chain 74, all of which are parallel to wheel 36 and covered by a protective shield 76. Rear sprocket 72 is fixed centrally upon a horizontal pedal crank shaft 79 which extends on each side, perpendicular to the plane of sprocket 72 and is rotatably journaled within a hub (not shown) welded to diagonal bar 40 beneath telescoping post 48. Shaft 79 terminates in pedal cranks 78 which extend in opposite directions perpendicular to shaft 79. Pedal cranks 78 are each connected at the terminal ends 80 thereof to a horizontal, rotatable pedal crank arm 77, each having a foot pedal 82 mounted swivelly along the axis thereof (FIG. 2).

Preferably, at least a heel strap 84 and an instep strap 86 are provided on each pedal 82 for retaining the user's foot F thereon. Straps 84, 86 are preferably lined with intermeshing hooks and eyes 88, such as VELCRO, however other conventional methods of attaching straps may be used, for example, a tongue and eye arrangement such as is commonly used in belts. Straps 84, 86 are of such length as to be capable of securing a wide range of foot sizes to pedals 82 (FIG. 6).

Thus, supplying electricity via cord 24 and controls 14 to motor 18 provides turning of bushing 22 on drive 20, causing rotation of wheel 36, in edgewise contact with bushing 22. Such rotation of wheel 36 in turn causes rotation of attached front sprocket 70 (see arrows FIG. 4), which motion is transferred via chain 74 to rear sprocket 72 causing turning of attached pedal crank shaft 79, crank arms 78 and swivelly mounted pedals 82, to move the feet F of a user P strapped thereto (FIG. 6).

Controls 14 may be adjustably positioned as described, as required by the size of user P and chair C on which user P is seated. Alternatively, the controls 14 may be removable from post 48 and operable either remotely or by means of electrical cord 24 flexibly attached to bicycle 10 in such a manner that user P may hold controls 14 upon his or her lap for more convenient use thereof. Speedometer 30 is located such as at the front of bicycle 10 above wheel 36 and positioned in view of user P for ascertaining the speed at which bicycle 10 is operating.

The illustrated selection of controls 14 (FIG. 5) permits user P, if capable, to operate bicycle 10 independently for a selected amount of time or alternatively user P may be assisted by an attendant who may set timer 66 for a preselected period, leave the area, and later return. Also, rheostat 68 permits bicycle 10 to be operated at various speeds depending upon the needs and capability of user P. Alternative possibilities for the controls 14 include providing on/off switch 64 in the form of a heat sensitive touch pad (not shown), rather than a toggle-type switch 64 as shown (FIG. 5). Also, manually adjustable timer 66 may be upgraded to be comprised of a digital-type timer and there is of course the overall potential for controls 14 being completely computer programmable for time and speed, as well as for a specific duration at certain speeds.

New passive exercise bicycle 10 provides the advantage of having very few moving parts and thus being inexpensive to produce as well as being durable and reliable. Its economical nature provides a welcome alternative for individuals in need of physical therapy at great expense. In some cases, the beneficial exercise provided by new bicycle 10 may substantially replace conventional physical therapy.

Furthermore, the weight and size of bicycle 10 allow it to be transported relatively easily by two people. Additionally, support platform 16 may be provided with lockable wheels (not shown) permitting transport by one person without sacrificing stability in use. The addition of handles 90 to support surface 16 will also facilitate movement or repositioning of bicycle 10.

Because the speed of motor 18 is easily and reliably controlled, user P may be strapped to pedals 82 and left relatively unattended. The design and operation of bicycle 10 permits the user's lower back, hip, upper leg, lower leg and ankle muscles to be stretched and carefully exercised, thereby improving circulation and decreasing muscle atrophy. Those users who have paralyzed legs can benefit from use of bicycle 10 by reduction of leg spasms, which are common in such individuals, as well as by reduction of swelling of the lower legs due to fluid pooling therein. Manual controls 14 are large and easy to use, even with only one hand. In some instances, individuals who do not have use of their hands can operate controls 14 by mouth and/or tool means (not shown).

In view of the foregoing, it will be seen that the general objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the forgoing description or shown in the accompanying drawings shall be interpreted as illustrative rather than limiting.

What is claimed is:

1. A passive exercise bicycle for use by a person seated in a chair; said bicycle comprising:

a) a vertical frame having a front portion, a rear portion and two opposing side portions;

b) a foot pedal rotatably attached adjacent to and extending outwardly from each opposing side portion near the rear portion of said frame;

c) a pedal crank assembly for simultaneously connecting said foot pedals in offset relationship relative to each other and permitting rotatable attachment to said frame;

d) strap means attached to each said foot pedal;

e) a vertical wheel attached to the front of said frame;

f) means for rotatably supporting said vertical wheel upon said frame front;

g) drive means connecting said wheel to said pedals;

h) means for selective rotation of said wheel including power supply means;

i) a support surface for fixed securement thereto of said frame and said means for selective rotation;

j) a pair of substantially vertical forward posts having a common upper end plate and two independent lower ends and means for mounting said vertical wheel therebetween;

k) an axle centrally penetrating said wheel for mounting between said vertical posts;

l) a rear post fixed to and positioned at an angle, forwardly and upwardly in relation to said support surface;

m) a substantially diagonal bar connecting said forward posts upper end plate to said rear post;

n) a telescoping post supported by said diagonal bar and said rear post for permitting positioning of said means for selective rotation of said wheel;

o) a front horizontal bar secured to said support surface for attaching said forward posts thereto such that said wheel is vertically positioned in spaced relationship above said support surface; and p) a rear horizontal bar secured to said support surface for fixing said rear post to said support surface;

whereby a person seated in a chair in alignment with the bicycle and facing the rear portion thereof may have his feet strapped to said foot pedals for passive exercise of the person's lower body by selective rotation of said vertical wheel.

2. The passive exercise bicycle of claim 1 wherein said drive means comprises a first sprocket connected centrally and parallel adjacent to said wheel, a second sprocket spacedly rearwardly connected to said first sprocket and having said pedals operationally attached thereto, and a continuous chain mounted upon and thereby connecting said first sprocket and said second sprocket for transmitting motion from said wheel to said pedals.

3. The passive exercise bicycle of claim 2 wherein said means for selective rotation of said wheel comprises power supply means comprising a motor attached to said support surface, a shaft extending from said motor and having a free outer end, a bushing connected to the end of said shaft and contacting said wheel edgewise such that operation of said motor resulting in turning of said shaft causes turning of said bushing with resultant rotation of said wheel and ultimate rotation of said pedals; and control means for selective operation of said motor.

4. The passive exercise bicycle of claim 3 wherein said control means comprises means for turning said motor on and off, means for timing the duration of motor operation, and means for determining the speed of rotation of said wheel, thereby determining the speed of rotation of said pedals; all of said control means being easily accessible by such person using said passive exercise bicycle.

5. The passive exercise bicycle of claim 4 wherein said bicycle further comprises a speedometer for monitoring the speed at which said bicycle is operating.

6. A passive exercise bicycle for use by a person seated in a chair; said bicycle comprising:

a) an upright frame having a front portion, a rear portion and two opposing side portions and extending longitudinally in front of the user;

b) a foot pedal rotatably attached adjacent to and extending outwardly from each opposing side portion near the rear portion of said frame;

c) a pedal crank assembly for simultaneously connecting said foot pedals in offset relationship relative to each other and permitting rotatably attachment to said frame;

d) adjustable strap means attached to each said foot pedal for adapting said foot pedals to various sizes of user's feet;

e) a vertical wheel attached to the from of said frame;

f) means for rotatably supporting said vertical wheel upon said frame front;

g) drive means connecting said vertical wheel to said pedals;

h) means for selective rotation of said vertical wheel including power supply means; and i) a support surface for fixed securement thereto of said frame and said means for selective rotation;

j) a pair of substantially vertical forward posts having a common upper end plate and two independent lower ends and means for mounting said vertical wheel therebetween;

k) an axle centrally penetrating said wheel for mounting said vertical posts;

l) a rear post fixed to and positioned at an angle, forwardly and upwardly in relation to said support surface;

m) a substantially diagonal bar connecting said forward posts upper end plate to said rear post;

n) a telescoping post supported by said diagonal bar and said rear post for permitting positioning of said means for selective rotation of said wheel;

o) a front horizontal bar secured to said support surface for attaching said forward posts thereto such that said wheel is vertically positioned in spaced relationship above said support surface; and p) a rear horizontal bar secured to said support surface for fixing said rear post to said support surface;

whereby the feet of a person seated in a chair in alignment with the bicycle and facing the rear portion thereof may be strapped to said foot pedals for passive exercise of the person's lower body by selective rotation of said vertical wheel.

7. The passive exercise bicycle of claim 6, wherein said adjustable strap means are formed so as to be capable of passing over the instep and around the outside of the heel of the person using said passive exercise bicycle.

8. The passive exercise bicycle of claim 6, wherein said means for selective rotation are mounted so as to be positionably adjustable.

9. The passive exercise bicycle of claim 6, wherein said frame comprises a telescoping post for permitting positioning of said means for selective rotation of said wheel.

10. The passive exercise bicycle of claim 6, wherein said support surface comprises means attached to said support surface for positioning said passive exercise bicycle.

11. The passive exercise bicycle of claim 6, wherein said power supply means comprises an electric motor connected to said means for selective rotation of said wheel and in contact with said vertical wheel.

12. The passive exercise bicycle of claim 6 wherein said drive means comprises a first sprocket connected centrally and parallel adjacent to said wheel, a second sprocket spacedly rearwardly connected to said first sprocket and having said pedals operationally attached thereto, and a continuous chain mounted upon and thereby connecting said first sprocket and said second sprocket for transmitting motion from said wheel to said pedals.

13. The passive exercise bicycle of claim 12 wherein said means for selective rotation of said wheel comprises power supply means comprising a motor attached to said support surface, a shaft extending from said motor and having a free outer end, a bushing connected to the end of said shaft and contacting said wheel edgewise such that operation of said motor resulting in turning of said shaft causes turing of said bushing with resultant rotation of said wheel and ultimate rotation of said pedals; and control means for selective operation of said motor.

14. The passive exercise bicycle of claim 13 wherein said control means comprises means for turning said motor on and off, means for timing the duration of motor operation, and means for determining the speed of rotation of said wheel, thereby determining the speed of rotation of said pedals; all of said control means being easily accessible by such person using said passive exercise bicycle.

15. The passive exercise bicycle of claim 6 wherein said bicycle further comprises a speedometer for monitoring the speed at which said bicycle is operating.

16. The combination of a chair, and a passive exercise bicycle for use by a person seated in said chair; said bicycle comprising;

a) an upright frame having a front portion, a rear portion and two opposing side portions and extending longitudinally in front of the user;

b) a foot pedal rotatably attached adjacent to and extending outwardly from each opposing side portion near the rear portion of said frame;

c) pedal crank assembly for simultaneously connecting said foot pedals in offset relationship relative to each other and permitting rotatably attachment to said frame;

d) adjustable strap means attached to said foot pedal for adapting said foot pedals to various sizes of user's feet;

e) a vertical wheel attached to the front of said frame;

f) means for rotatably supporting said vertical wheel upon said frame front;

g) drive means connecting said vertical wheel to said pedals;

h) means for selective rotation of said vertical wheel including power supply means;

i) a support surface for fixed securement thereto of said frame and said means for selective rotation;

j) a pair of substantially vertical forward posts having a common upper end plate and two independent lower ends and means for mounting said vertical wheel therebetween;

k) an axle centrally penetrating said wheel for mounting said vertical posts;

l) a rear post fixed to and positioned at an angle, forwardly and upwardly in relation to said support surface;

m) a substantially diagonal bar connecting said forward posts upper end plate to said rear post;

n) a telescoping post supported by said diagonal bar and said rear post for permitting positioning of said means for selective rotation of said wheel;

o) a front horizontal bar secured to said support surface for attaching said forward posts thereto such that said wheel is vertically positioned in spaced relationship above said support surface; and p) a rear horizontal bar secured to said support surface for fixing said rear post to said support surface;

whereby the feet of a person seated in a chair in alignment with the bicycle and facing the rear portion thereof may be strapped to said foot pedals for passive exercise of the person's lower body by selective rotation of said vertical wheel.

17. The combination of claim 16, wherein said chair is capable of use independent of said combination.

18. The combination of claim 16, wherein said chair is a conventional wheel chair, whereby a person confined to said wheel chair may use the passive exercise bicycle of said combination without the aid of another person.

* * * * *